United States Patent [19]

Kirsten

[11] Patent Number: 4,616,787

[45] Date of Patent: Oct. 14, 1986

[54] PORTABLE PROJECTION APPARATUS

[75] Inventor: Walter Kirsten, Weinheim, Fed. Rep. of Germany

[73] Assignee: BKW Handels-und Vertriebsgesellschaft, Weinheim, Fed. Rep. of Germany

[21] Appl. No.: 605,028

[22] PCT Filed: Aug. 26, 1983

[86] PCT No.: PCT/DE83/00148

§ 371 Date: Apr. 16, 1984

§ 102(e) Date: Apr. 16, 1984

[87] PCT Pub. No.: WO84/00917

PCT Pub. Date: Mar. 15, 1984

[30] Foreign Application Priority Data

Aug. 26, 1982 [DE] Fed. Rep. of Germany ..... 3231787

[51] Int. Cl.[4] ..... B02C 19/00

[52] U.S. Cl. ..... 241/275; 198/641

[58] Field of Search ..... 198/620, 626, 642, 627, 198/628, 638, 639, 640, 641, 840, 813, 814, 815, 816, 835; 239/668, 669, 684, 681; 241/5, 275, 200

[56] References Cited

U.S. PATENT DOCUMENTS

| | | | |
|---|---|---|---|
| 3,592,393 | 7/1971 | Sinden | 241/275 X |
| 3,592,394 | 7/1971 | Sinden | 241/275 X |
| 3,980,174 | 9/1976 | Conrad | 198/840 X |

FOREIGN PATENT DOCUMENTS

| | | | |
|---|---|---|---|
| 142816 | 8/1951 | Australia | 198/638 |
| 1073345 | 8/1956 | Fed. Rep. of Germany . | |
| 2126076 | 12/1971 | Fed. Rep. of Germany | 241/275 |
| 2559206 | 7/1977 | Fed. Rep. of Germany | 198/642 |
| 589022 | 5/1925 | France . | |
| 1173872 | 10/1958 | France | 241/200 |
| 1230560 | 9/1960 | France | 198/840 |
| 2240077 | 3/1975 | France . | |

*Primary Examiner*—Mark Rosenbaum

*Attorney, Agent, or Firm*—Jordan and Hamburg

[57] ABSTRACT

A portable projection apparatus has an endless belt running over rollers and a rotatable disk having a band on its outer surface. The endless belt partially embraces the band, and the projection material is accelerated between grooves in the band and the endless belt. The band with the longitudinal grooves can be easily exchanged for other groove cross-sections and the interior surface of the belt is provided with a profiling which runs parallel to the circumferential direction, into which the outer surface of the rollers, guiding the endless belt engage with a corresponding profile.

19 Claims, 3 Drawing Figures

PORTABLE PROJECTION APPARATUS

BACKGROUND OF THE INVENTION

The invention relates to a portable projection apparatus with an endless belt running on rollers, and a rotatable disk having a band at its outer surface with the endless belt partially embracing the band and with the projection material being accelerable between the outer surfaces of the band and the endless belt.

Federal Republic of Germany No. OS 1 073 345 discloses an apparatus for the production of a beam of granular material in which a band moves around the partial circumference of a rotating disk. It is a disadvantage of this apparatus that no continuous movement is possible since the projection material supply has to be adjusted separately by hand in order for the projection material to be grasped by the band and the disk. In the case of uneven supply of projection material, the band slips off because of the lack of a precise forced guidance, and thus there is no assurance that additional projection material will be carried along and that the apparatus is functional. This apparatus is stationarily arranged.

Such an apparatus was once built and tried by the inventor. It was confirmed that it did not work in practical use. The band did not remain on track, ran into the rims, and broke.

It is an object of the invention to provide an apparatus of the initially-mentioned type in which a secure positive guidance of the endless belt is assured so that the endless belt does not slide off from the rollers during the operation of the projection apparatus. Furthermore, a targeted projection of the projection material is to be carried out without the endless belt sliding off laterally. The retightening of the endless belt can be accomplished in a simple fashion.

The object of the invention is accomplished in that the outer surface of the band has longitudinal grooves and in that the interior surface of the endless belt has a profiling which runs parallel to the circumferential direction, into which the outer surface of the rollers, guiding the endless belt, engage with a corresponding profile.

When the band is rotating with the disk, the endless belt, which partially embraces the band, is brought along tensionally by the band, with the projection material being located between the grooves of the band and the endless belt. By rotating the band with the disk, the supplied projection material is grasped, accelerated and then projected tangentially. The endless belt is forcibly guided with its interior surface and the outer surface of the rollers, with the endless belt not being able to slide off from the roller laterally. Thus it is assured that even in the case of uneven supply of the projection material, the endless belt remains securely in its position. The projection material is accelerated between the longitudinal grooves of the band and the outer surface of the endless belt. This mode of operation resembles a belt drive, only under different conditions.

Particularly advantageous embodiments of the apparatus in the invention will be disclosed in the subordinate claims.

The invention is to be explained further by means of the enclosed drawing.

DESCRIPTION OF THE PREFERRED EMBODIMENTS

Figure 1:
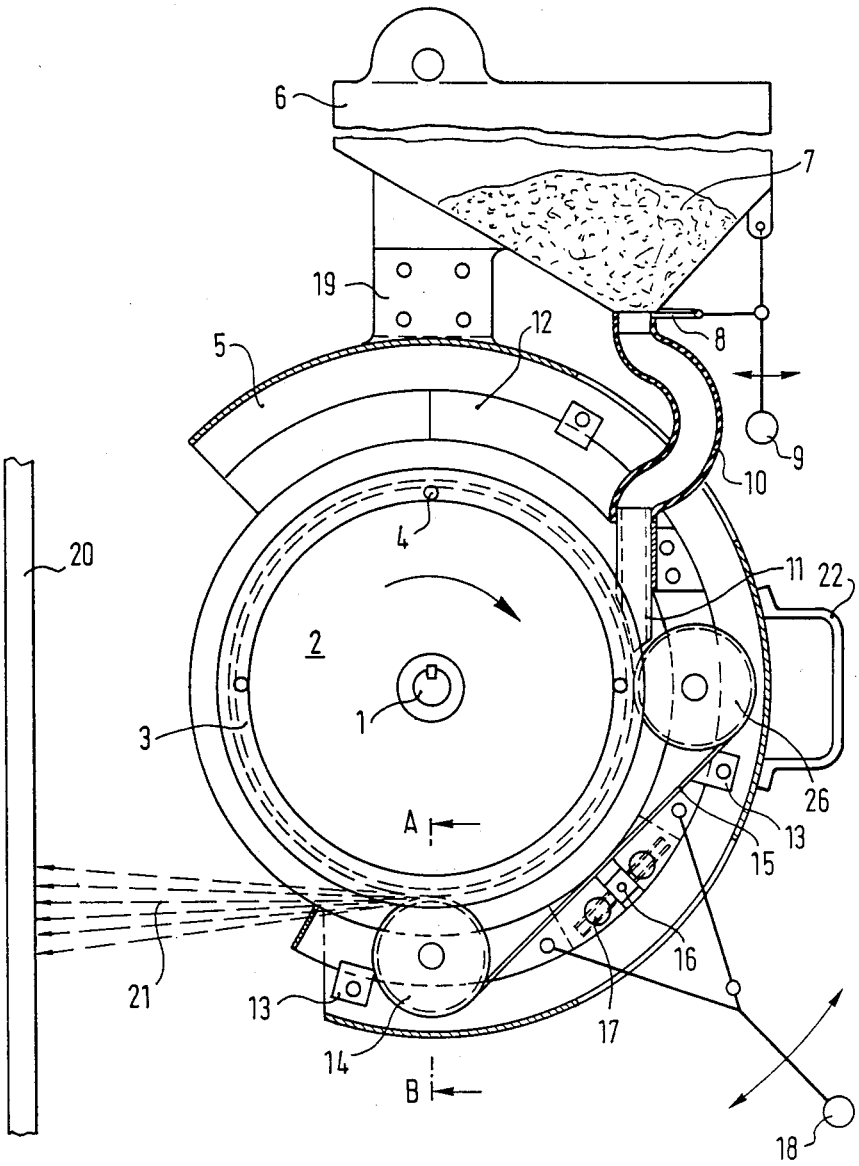
FIG. 1 is a lateral view of the projection apparatus according to one embodiment of the invention shown in cross-section.
Figure 2:
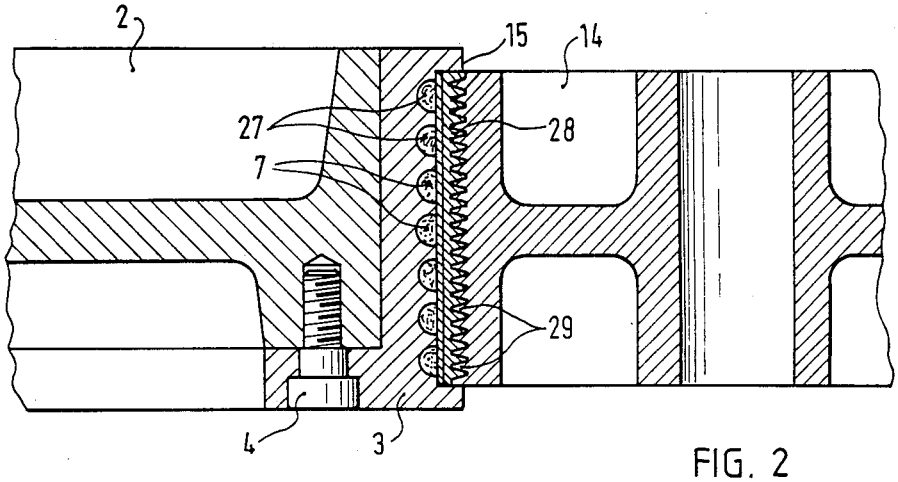
FIG. 2 is a partial cross-sectional view taken along the line A-B shown in FIG. 1.

Referring to FIGS. 1 and 2, a disk 2 with a rim or band 3 is operated by an electric motor 1 which is partially shown. The disk 2 has the band 3 on its outer surface. This band 3 has conveyor grooves which, with a flange on one side, overlap the surface of the disk and are fastened via borings with clamping bolts 4 to the disk 2. A projection housing 5 provides for the projection and mounting of additional parts. A projection material container 6 is rigidly connected to the housing 5 by a strap connection 19. After a control gate has been opened by means of a control lever 9 which has an open and closed position, the projection material 7 will slide into the movable hose 10. The hose 10 is preferably formed as a rubber hose and transports the projection material 7 to the projection material supply line 11 which is fastened onto a ring means or a ring target 12.

The ring target 12 is divided transversely and provides for the retightening or tensioning of the endless belt 15 by means of a threaded clamp bolt 16, and carriers the projection material supply line 11, two belt rollers 14 and 26, the threaded clamp bolt 16 with right- and left-hand threads, the two thread stops 17 and the swivel arm 18 Ring target guides 13 are formed as strap guides to slidably guide the ring target 12 on the housing 5. The endless belt 15 runs over the two rollers 14 and 26. The rollers 14 and 26 have a profile 29 on their outer surface which engages into the profiling 28 on the interior surface of the endless belt 15. This profiling, formed as longitudinal grooves, prevents the sliding off of the endless belt 15 from the rollers 14 and 26. In the illustrated embodiment, the profilings 28 and 29 run across the entire width of the endless belt 15 and the rollers 14 and 26. They engage into one another in a geared fashion. Furthermore, the band 3 has longitudinal grooves 27 which are semicircular in cross-section. The projection material is located in these longitudinal grooves 27 of the band 3 and on the endless belt 15. The produced beam 21 hits the object 20 to be projected. A handle 22 is fastened to the housing 5.

When the disk 2 rotates with the band 3 in the direction of the arrow indicated in FIG. 1, the projection material supplied between the band 3 and the endless belt 15 via the projection material supply line 11 is grasped and brought to the necessary speed so that it hits the object to be projected 20 as beam 21. With the swivel arm 18, the ring target 12 can be adjusted so that the direction of the exiting beam can thereby be changed. By turning the threaded clamp bolt 16, a change in the tension of the endless belt 15 can be accomplished via the rollers 14 and 26.

Figure 3:
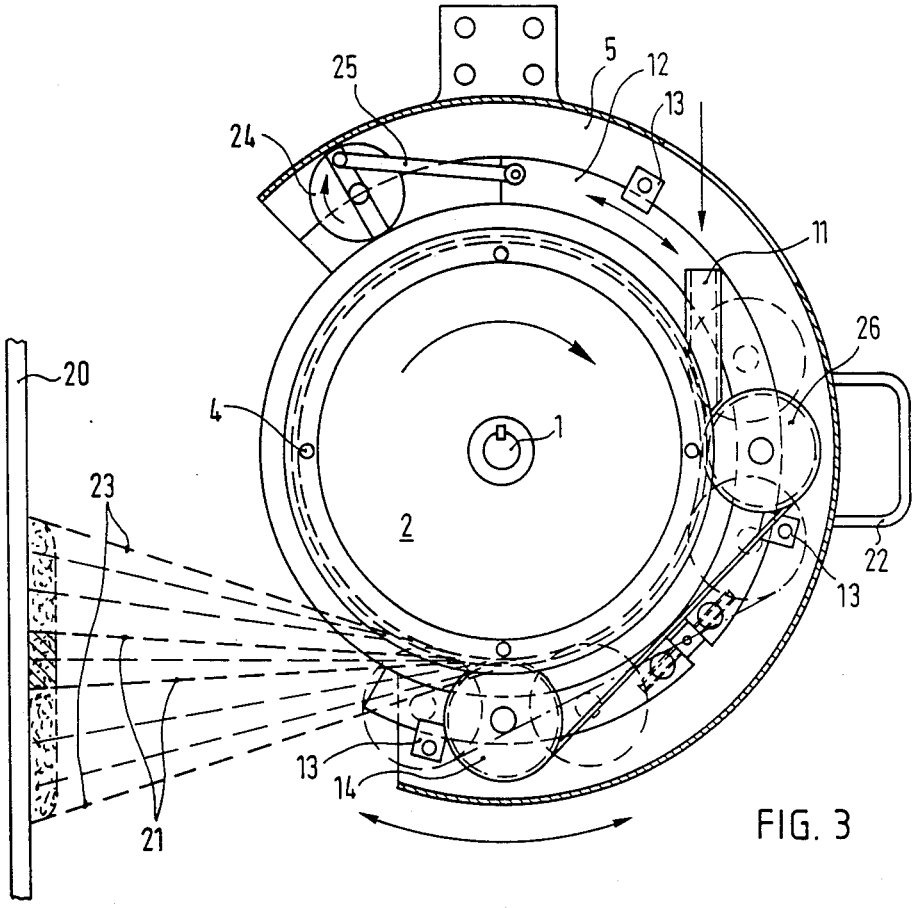
FIG. 3 is a lateral view of the portable projection apparatus according to another embodiment of the invention shown in cross-section with an eccentric disk and crank.

Instead of a swivel arm 18, FIG. 3 shows another embodiment wherein the ring target 12 is rotated to relative to the housing 5 by an eccentric disk 24 with motor. A crank 25 establishes the connection between the eccentric disk 24 and the ring target 12. In this embodiment, the projection apparatus has a continuously working and rotating ring target 12. When this apparatus is operated with the eccentric disk 24, the result is a larger and extended beam area 23, as compared to the beam 21. This additional embodiment has greater advantages since the beam area length can be adjusted to the workpiece surface. No projection material is wasted, and the surfaces are hit more intensively and radiated in a shorter time. Manual operation of the swivel arm 18, according to FIG. 1, cannot be accomplished in the same even manner by operating personnel, resulting in an unclear projection image.

In each of the illustrated embodiments, the endless belt 15 runs with longitudinal grooves in the two grooved tension rollers 14 and 26, thus preventing sliding off from the band 3 in the case of an uneven supply of the projection material. According to FIG. 2, the band 3 guides the endless belt 15 laterally through the rims so that sliding off from the band 3 is prevented here as well. By the pre-tensioning of the endless belt 15, this is pressed against the band 3, working tensionally an thus enclosing the projection material 7 in the deep grooves 27 of the band 3, effectuating an acceleration through the band 3 and the endless belt 15, which resembles a belt drive. The tension of the endless belt 15 and the adjustment of the divided ring target 12 is effectuated by the threaded clamp bolt 16 with right- and lefthanded threads.

Apparatus according to the embodiments shown in the drawings has been successful in trial runs.

1. With this apparatus all existing projection means can be used since the projection means is not smashed within the apparatus.

2. Higher projection material throughput at smaller motor capacities are achieved since no air has to be conveyed, as in fan blowers.

3. The beam position can be easily and precisely adjusted to the object to be projected.

4. This apparatus runs without imbalance and is therefore noiseless.

5. The endless belt allows release speeds of up to 80 m/s.

6. This apparatus needs no pre-acceleration, since there is a shockless and continuously flowing supply at full rotational speed.

7. In stationary apparatus, operating personnel can work under the beam wearing protective gloves, since there is no danger of the blade breaking and threatening the worker.

I claim:

1. Portable projection apparatus comprising a housing, a disk member rotatably mounted on said housing about a central axis, an outer band member mounted on said disk member, said outer band member having a plurality of spaced outer band grooves for receiving projecting material, said band grooves being parallel to one another and extending endlessly circumferentially around the outer peripheral surface of said outer band member, a belt means partially in contact with a circumferential area of said outer band member, said belt means comprising an endless belt and rollers over which said endless belt is disposed, said belt means further comprising ring means disposed radially outwardly of said outer band member and rotatably movable on said housing, said rollers being mounted on said rings means, and operable means operably connected to said ring means for rotating and displacing said ring means about said central axis such that said rollers are displaced together with said ring means so that the entire circumferential area of said endless belt which contacts said drum member is circumferentially displaced about said central axis.

2. Portable projection apparatus according to claim 1 wherein there are two spaced rollers, said endless belt having two runs disposed between said two rollers, one of said runs being in contact with said band member.

3. Portable projection apparatus according to claim 1 wherein said grooves in said band member are semi-circular in cross section.

4. Portable projection apparatus according to claim 1 further comprising fastening means for detachably fastening said band member to said disk member.

5. Portable projection apparatus according to claim 1 further comprising supply means for supplying projection material between said band member and said endless belt, said supply means comprising a projection material supply conduit opening into the converging space between said band member and said endless belt, said supply conduit being mounted on said ring means.

6. Portable projection apparatus according to claim 5 wherein said supply means comprises a supply hopper mounted on said housing, and a flexible conduit between said hopper and said supply conduit.

7. Portable projection apparatus according to claim 1 wherein said housing has a partial circular configuration greater than an opening portion through which the projection material is projected.

8. Portable projection apparatus comprising a housing, a disk member rotatably mounted in said housing, an outer band member mounted on said disk member, said outer band member having a plurality of spaced outer band grooves for receiving projecting material, said band grooves being parallel to one another and extending endlessly circumferentially around the outer peripheral surface of said outer band member, a belt means partially in contact with said outer band member, said belt means comprising an endless belt and rollers over which said endless belt is disposed, said endless belt having an inner surface having a plurality of spaced belt grooves parallel to each other and extending endlessly along the inner circumference of said endless belt, said rollers having a plurality of spaced projections parallel to each other and extending endlessly around the outer surface of said rollers, said projections engaging said belt grooves such that said endless belt is prevented from sliding off of said rollers, said belt means further comprising ring means rotatably movable on said housing, said rollers being mounted on said ring means, said ring means comprising at least two ring segments with one of said rollers being mounted on one of said ring segments and another of said rollers being mounted on another ring segment, and adjustment means operably connected to said two ring segments to move said two ring segments relative to one another and thereby adjust the relative positions of said two rollers, thereby adjusting the tension of said endless belt.

9. Portable projection apparatus according to claim 8, wherein said belt grooves extend across the entire width of said endless belt, said projections in said rollers extending across the entire width of said rollers, said belt grooves receiving and engaging said projections in gear-like fashion in cross-section.

10. Portable projection apparatus according to claim 8 wherein said two ring segments are movable about the axis of said rotatable disk by said adjustment means.

11. Portable projection apparatus according to claim 8 wherein said adjustment means comprises a threaded element threadedly engaging said two ring segments.

12. Portable projection apparatus according to claim 8 further comprising operable means for rotating said two ring segments together relative to said housing to thereby vary the circumferential position at which said endless belt engages said band member.

13. Portable projection apparatus according to claim 12 wherein said operable means comprises a swivel arm which is manually movable.

14. Portable projection apparatus according to claim 12 wherein said operable means comprises a motor driven eccentric disk which operates a crank arm for rotating said two ring segments together relative to said housing.

15. Portable projection apparatus comprising a housing, a disk member rotatably mounted on said housing about a central axis, an outer band member mounted on said disk member, said outer band member having a plurality of spaced outer band grooves for receiving projecting material, said band grooves being parallel to one another and extending endlessly circumferentially around the outer peripheral surface of said outer band member, a belt means partially in contact with a circumferential area of said outer band member, said belt means comprising an endless belt and rollers over which said endless belt is disposed, said endless belt having an inner surface having a plurality of spaced belt grooves parallel to each other and extending endlessly along the inner circumference of said endless belt, said rollers having a plurality of spaced projections parallel to each other and extending endlessly around the outer surface of said rollers, said projections engaging said belt grooves such that said endless belt is prevented from sliding off of said rollers, said belt means further comprising ring means disposed radially outwardly of said outer band member and rotatably movable on said housing, said rollers being mounted on said ring means, said ring means further comprising at least two ring segments with one of said rollers being mounted on one of said ring segments and another of said rollers being mounted on another ring segment, tension adjustment means operably connected to said two ring segments to move said two ring segments relative to one another and thereby adjust the relative positions of said two rollers to thereby adjust the tension of said endless belt, and adjustment means operably connected to said ring means for rotating said ring means about said central axis such that the circumferential area of said band member which is contacted by said endless belt is circumferentially displaced.

16. Portable projection apparatus according to claim 15, wherein said adjustment means comprises an eccentric disc mounted on said housing and a crank arm operably connected between said eccentric disc and ring means such that rotation of said eccentric disc operates said crank arm to rotate said ring means about said central axis.

17. Portable projection apparatus according to claim 16, wherein there are two rollers over which said endless belt passes, said two rollers being circumferentially spaced from one another about ninety degrees.

18. Portable projection apparatus according to claim 15, wherein said tension adjustment means comprises a tension member connected to said two ring segments and operably adjustable to rotate said two ring segments in the opposite direction about said central axis to thereby vary the circumferential spacing between said two ring segments and thereby adjust the tension of said endless belt.

19. Portable projection apparatus according to claim 15, further comprising supply means for supplying projection material between said band member and said endless belt, said supply means comprising a flexible projection material supply conduit having a discharge end opening into the converging space between said band member and said endless belt, said supply conduit having its discharge end mounted on said ring means such that said discharge end moves with said ring means as said ring means is rotated by said adjustment means.

* * * * *